US005386853A

United States Patent [19]

Speich

[11] Patent Number: 5,386,853

[45] Date of Patent: Feb. 7, 1995

[54] GRIPPER LOOM WITH PNEUMATIC GRIPPER CLEANING APPARATUS

[75] Inventor: Francisco Speich, Gipf-Oberfrick, Switzerland

[73] Assignee: Textilma AG, Hergiswil, Switzerland

[21] Appl. No.: 946,446

[22] PCT Filed: Jan. 16, 1992

[86] PCT No.: PCT/CH92/00009

§ 371 Date: Oct. 23, 1992

§ 102(e) Date: Oct. 23, 1992

[87] PCT Pub. No.: WO92/15738

PCT Pub. Date: Sep. 17, 1992

[30] Foreign Application Priority Data

Mar. 8, 1991 [CH] Switzerland ..... 710/91

[51] Int. Cl.[6] ..... D03J 1/00; D03D 47/20

[52] U.S. Cl. ..... 139/1 C; 139/438; 139/448

[58] Field of Search ..... 139/1 C, 438, 439, 441, 139/442, 444, 445, 446, 447, 448

[56] References Cited

U.S. PATENT DOCUMENTS

| | | | |
|---|---|---|---|
| 3,542,595 | 11/1970 | McCullough et al. | 139/439 |
| 4,230,158 | 10/1980 | Hintsch | 139/1 C |
| 4,320,785 | 3/1982 | Zwiener | 139/494 |
| 4,640,315 | 2/1987 | Gascsay | 139/1 C |

FOREIGN PATENT DOCUMENTS

| | | | |
|---|---|---|---|
| 1563122 | 4/1969 | France | 139/439 |
| 2145351 | 5/1972 | Germany | 139/439 |
| 2644343 | 4/1977 | Germany | 139/1 C |
| 555918 | 11/1974 | Switzerland . | |
| 667117 | 9/1988 | Switzerland | 139/439 |

*Primary Examiner*—Andrew M. Falik

*Attorney, Agent, or Firm*—Anderson Kill Olick & Oshinsky

[57] ABSTRACT

A gripper loom with pneumatic gripper cleaning apparatus is outfitted with at least one gripper associated with a blowing nozzle outside of the weaving area. The blowing nozzle is associated with a suction nozzle on the opposite side of the gripper. The gripper is constructed in such a way that it allows air to pass from the blowing nozzle to the suction nozzle. This enables an intensive and complete cleaning of the gripper and prevents soiling of other structural component parts.

17 Claims, 2 Drawing Sheets

GRIPPER LOOM WITH PNEUMATIC GRIPPER CLEANING APPARATUS

FIELD OF THE INVENTION

The invention is directed to a gripper loom which has at least one gripper associated with the blower nozzle of a blowing device, outside of the weaving area, characterized in that a suction nozzle of a suction device is associated with the blowing nozzle on the opposite side of the gripper. The blowing nozzle is directed against the opening of the suction nozzle and the gripper is constructed in such a way that it enables air to pass from the blowing nozzle to the suction nozzle.

BACKGROUND OF THE INVENTION

A gripper loom of the above-indicated type is known e.g. from DE-PS 26 44 343. An air jet is directed against the gripper when the gripper is opened. However there is a risk that dust, lint and yarn remainders will be blown into the gripper or other parts of the gripper loom by the air jet directed toward the gripper and settle there in a troublesome manner and/or load the environment.

SUMMARY OF THE INVENTION

The object of the invention is to construct a gripper loom in such a way that the aforementioned disadvantages are avoided.

The object is met according to the invention by providing a gripper loom which has at least one gripper associated with the blower nozzle of a blowing device, outside of the weaving area, characterized in that a suction nozzle of a suction device is associated with the blowing nozzle on the opposite side of the gripper. The blowing nozzle is directed against the opening of the suction nozzle and the gripper is constructed in such a way that it enables air to pass from the blowing nozzle to the suction nozzle. An optimal cleaning of the gripper is provided, while dirt, lint and yarn remainders are simultaneously prevented from depositing in other parts of the gripper loom, in that a blowing nozzle acts on the gripper on one side and a suction nozzle acts on the gripper on the other side and the gripper is further constructed in such a way that it is possible for air to pass across from the blowing nozzle to the suction nozzle. An optimal operating reliability of the gripper loom and preservation of the environment are accordingly achieved.

Advantageous constructions of the gripper loom are described herein.

It is possible to arrange the blowing nozzle on the draw-off side of the gripper, i.e. on the side facing the draw-off device. However, a construction wherein the blowing nozzle is arranged on the shed forming side of the gripper, is more advantageous, whereby any risk of lint, dust and the like reaching the shed region and being incorporated into the woven fabric is prevented.

A construction of the gripper loom, wherein the axis of the blowing nozzle and the axis of the suction nozzle lie at least approximately on a common axis which preferably extends parallel to the fabric web, is particularly advantageous, since the blowing nozzle then blows impurities directly into the suction nozzle by means of the air flow. This is reinforced when the common axis of the blowing nozzle and suction nozzle lies parallel to the fabric web. It has been shown that optimal results can be achieved with the arrangement of the common axis, wherein the common axis forms an angle of 30° to 150° with the running direction of the gripper. It is possible per se to construct the suction device in such a way that the suction process is turned off when the filling thread is inserted into the weaving location. However, it has been shown that better results are obtained when the suction device is in use continuously and is in use without intermission. On the other hand, it is advantageous that the blowing nozzle not be used continuously, but only when the gripper is also actually located in the region of the blowing nozzle. A construction, wherein a magnet valve is arranged in the feed line to the blowing nozzle and having its distance from the blowing nozzle preferably less than 200 mm, is suitable for controlling the compressed air. The closer the magnet valve is arranged to the blowing nozzle, the lower the losses of compressed air and the better the cleaning results. It is particularly advisable that the compressed air supply be adjusted to respective requirements, so a construction wherein the magnet valve can be program-controlled is recommended. Accordingly, it is possible e.g. to tailor the compressed air process particularly to the filling threads to be used in each instance so that especially fluffy and high-lint yarns are subjected to a more intensive air treatment than is necessary with smooth artificial yarns. A reduction in the energy requirement and accordingly in the operating costs of the gripper loom is also made possible by adapting the compressed air flow to respective needs. Particularly favorable results are provided when the gripper loom is constructed so that the blowing takes place during the filling insertion cycle from 290° to 70° and when the pressure of the compressed air is less than 6 bar A construction, wherein the gripper loom has a supplying gripper on one weaving side and a fetching gripper on the other weaving side, wherein each gripper is associated with a blowing nozzle and a suction nozzle, is advantageous in the case of gripper looms which have a supplying gripper on one side and a fetching gripper on the side of the loom.

Embodiment examples of the subject matter of the invention are described in more detail in the following with reference to the drawings.

DETAILED DESCRIPTION OF THE PREFERRED EMBODIMENT

Figure 1:
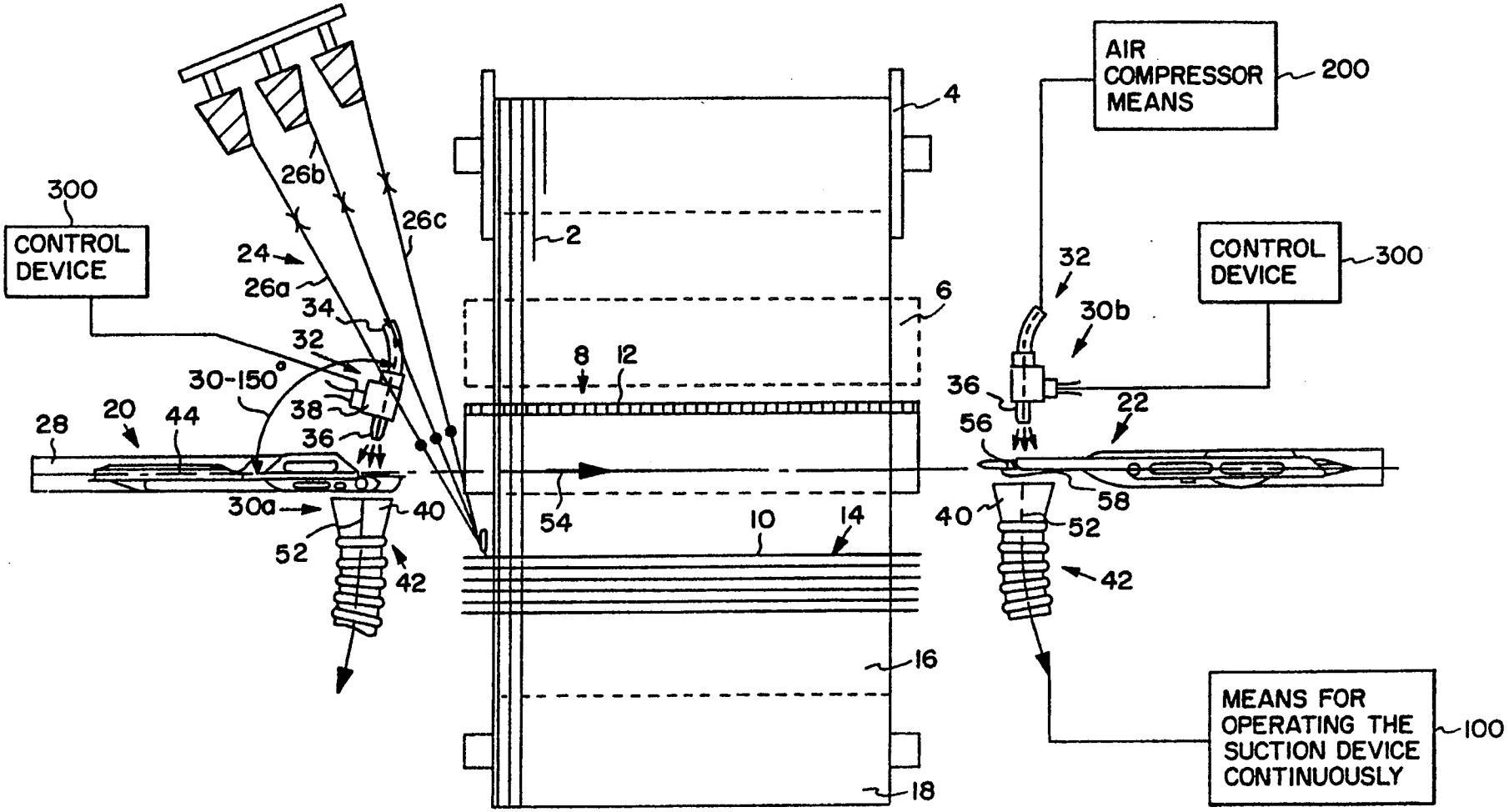
FIG. 1 is a diagram of a gripper loom in horizontal projection.

FIG. 1 shows the diagram of a gripper loom in horizontal projection, the warp threads 2 being guided to the weaving area 8 by a warp beam 4 via a shedding device 6. Filling threads 10 are inserted into an open shed in the weaving area 8 and beat up at a beating-up edge 14 by means of a weaving reed 12. The completed woven fabric, i.e. the fabric web 16, is drawn off and wound up by means of a fabric beam 18.

In the present case, two grippers 20, 22 serve to insert the filling thread. One gripper 20 is constructed as a supplying gripper and inserts the threads 26*a* to 26*c* presented by a filling thread feed device 24 into the first half of the shed. The thread is taken up by the gripper 22 constructed as a fetching gripper and is completely drawn through the shed. Each gripper 20, 22 is fastened to a gripper bar 28 which guides it into and out of the shed in a reciprocating manner. The grippers 20, 22 are associated with cleaning devices 30*a*, 30*b* in the regions lying outside of the weaving area 8.

The cleaning device 30*a* associated with the supplying gripper 20 contains a blowing device 32 which supplies compressed air to a blowing nozzle 36 via a feed line 34. A magnet valve 38 which is arranged as close as possible to the blowing nozzle 36 is provided for controlling the compressed air, the distance being no greater than 200 mm. The blowing nozzle lies on the side of the supplying gripper 20 associated with the shedding device 6. A suction nozzle 40 of a suction device 42 is associated with the blowing nozzle 36 on the side associated with the fabric beam 18. The suction nozzle 40 is provided with an elongated opening extending in the direction of the gripper 20.

Figure 2:
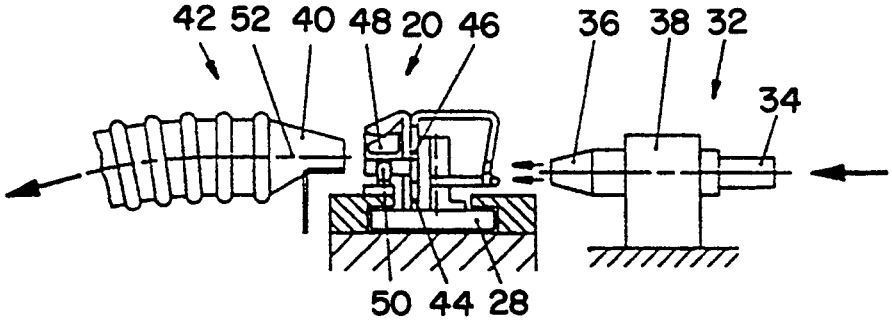
FIG. 2 shows the arrangement of a blowing nozzle and a suction nozzle at the gripper in a plan view proceeding from the weaving area.

As can be gathered particularly from FIG. 2, the supplying gripper 20 is constructed in such a way that its carrier 44 connected with the gripper bar 28 has openings 46 through which the compressed air arrives directly between the opened clamping jaws 48, 50 of the supplying gripper from the blowing nozzle and into the opening of the suction nozzle again. For this purpose, the axes of the blowing nozzle 36 and suction nozzle 40 are arranged on a common axis 52 which lies parallel to the fabric web 16 on the one side and forms an angle of 30° to 150° with the running direction 54 of the supplying gripper 20 on the other side.

The cleaning device 30*b* associated with the fetching gripper 22 is constructed similarly to the cleaning device 30*a*. In the case of the fetching gripper the cleaning device acts on a catch hook 56 which takes over the filling thread 10 from the supplying gripper 20 and holds it by means of a clamping strip 58. The clamping strip is opened in the position shown in FIG. 1 by a mechanism which is not shown in the drawing. The blowing device can possibly facilitate the disengagement of the caught thread.

Figure 3:
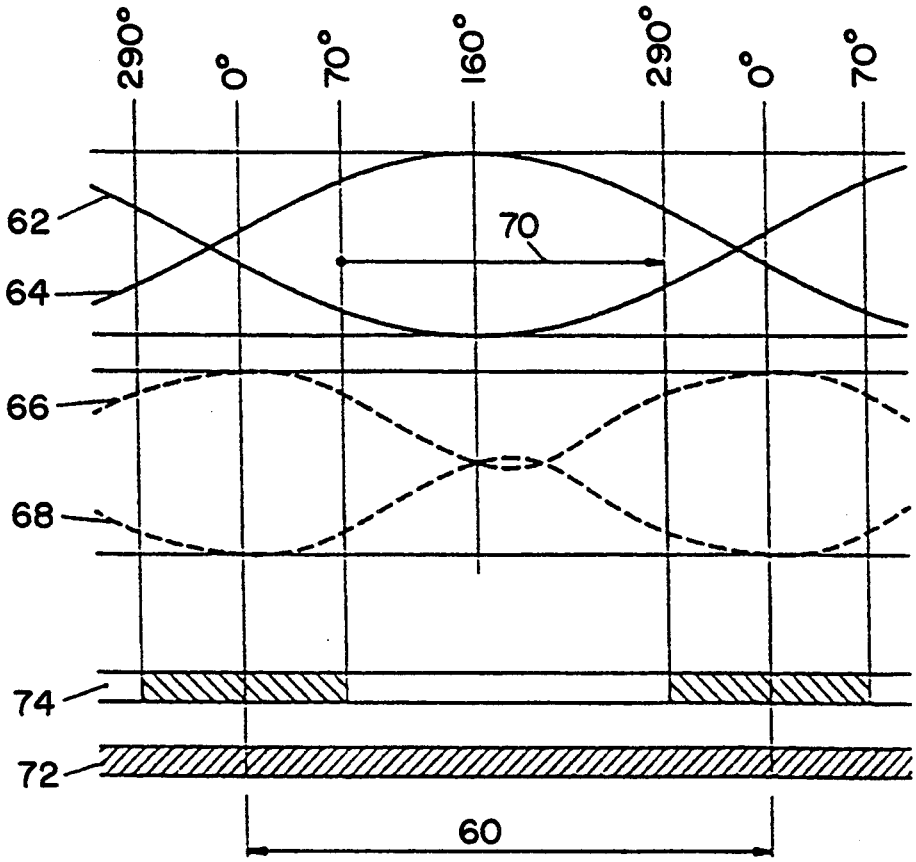
FIG. 3 shows a function diagram of the gripper loom.

FIG. 3 shows the manner of operation of the cleaning device during a filling insertion cycle 60 with reference to the angle of rotation of the main shaft. The curves 62 and 64 show the shedding. Curves 66 and 68 illustrate the motion of the grippers 20, 22. The filling insertion 70 is effected at an angle of rotation between 70° and 290°. Whereas the suction operation 72 of the suction device 42 is continuous which is effected by the means for operating the suction device 100 continuously, the blowing operation 74 of the blowing device 32 is effected by air compressor means 200 only immediately before the filling insertion 70 during an angle of rotation of 290° to 70°. The magnet valve 38 is connected with a programmable control device 300, particularly a pattern control device of the gripper loom. Accordingly, it is possible to control the blowing device in such a way that it can be adjusted to different types of thread, woven patterns and the like.

I claim:

1. A gripper loom, comprising:

at least one gripper associated with a blower nozzle of a blowing device outside of a weaving area, wherein said blowing device is located on a first side of said gripper, and further wherein a suction nozzle of a suction device is associated with said blowing nozzle, and further wherein said suction device is located on a side of said gripper which is opposite said first side, wherein said blowing nozzle is directed against an opening of the suction nozzle, and wherein said gripper includes means for passing air from said blowing nozzle to said suction nozzle, wherein an axis of said blowing nozzle and an axis of said suction nozzle lie at least approximately on a common axis which extends parallel to a fabric web, wherein said common axis forms an angle of 30° to 150° with a running direction of said gripper.

2. A gripper loom comprising:

at least one gripper associated with a blower nozzle of a blowing device outside of a weaving area, wherein said blowing device is located on a first side of said gripper, and further wherein a suction nozzle of a suction device is associated with said blowing nozzle, and further wherein said suction device is located on a side of said gripper which is opposite said first side, wherein said blowing nozzle is directed against an opening of the suction nozzle, and wherein said gripper includes means for passing air from said blowing nozzle to said suction nozzle, wherein said gripper loom further comprises:

a means for operating said suction device continuously.

3. A gripper loom comprising:

at least one gripper associated with a blower nozzle of a blowing device outside of a weaving area, wherein said blowing device located on a first side of said gripper, and further wherein a suction nozzle of a suction device is associated with said blowing nozzle, and further wherein said suction device is located on a side of said gripper which is opposite said first side, wherein said blowing nozzle is directed against an opening of the suction nozzle, and wherein said gripper includes means for passing air from said blowing nozzle to said suction nozzle, wherein a magnet valve is arranged in a feed line to said blowing nozzle, and wherein its distance from said blowing nozzle is less than 200 mm.

4. A gripper loom comprising:

at least one gripper associated with a blower nozzle of a blowing device outside of a weaving area, wherein said blowing device is located on a first side of said gripper, and further wherein a suction nozzle of a suction device is associated with said blowing nozzle, and further wherein said suction device is located on a side of said gripper which is opposite said first side, wherein said blowing nozzle is directed against an opening of the suction nozzle, and wherein said gripper includes means for passing air from said blowing nozzle to said suction nozzle, wherein a magnet valve is arranged in a feed line to said blowing nozzle, and wherein its distance from said blowing nozzle is less than 200 mm, wherein said magnet valve is adapted to be program-controlled.

5. A gripper loom comprising:

at least one gripper associated with a blower nozzle of a blowing device outside of a weaving area, wherein said blowing device is located on a first side of said gripper, and further wherein a suction nozzle of a suction device is associated with said blowing nozzle, and further wherein said suction device is located on a side of said gripper which is opposite said first side, wherein said blowing nozzle is directed against an opening of the suction nozzle, wherein said gripper includes means for passing air from said blowing nozzle to said suction nozzle, during a blowing operation of said blowing device, and wherein said gripper loom includes means for causing said blowing operation of said blowing device to take place during a filling insertion cycle which ranges from 290° to 70°.

6. A gripper loom comprising:

at least one gripper associated with a blower nozzle of a blowing device outside of a weaving area, wherein said blowing device is located on a first side of said gripper, and further wherein a suction nozzle of a suction device is associated with said blowing nozzle, and further wherein said suction device is located on a side of said gripper which is opposite said first side, wherein said blowing nozzle is directed against an opening of the suction nozzle, and wherein said gripper includes means for passing air from said blowing nozzle to said suction nozzle, wherein said blowing device including means for supplying compressed air having pressure of less than 6 bar.

7. A gripper loom comprising:

at least one gripper associated with a blower nozzle of a blowing device outside of a weaving area, wherein blowing device is located on a first side of said gripper, and further wherein a suction nozzle of a suction device is associated with said blowing nozzle and further wherein said suction device is located on a side of said gripper which is opposite said first side, wherein said blowing nozzle is directed against an opening of the suction nozzle, and wherein said gripper includes means for passing air from said blowing nozzle to said suction nozzle, wherein said gripper loom further comprises:

a supplying gripper on a first weaving side; and a fetching gripper on a second weaving side, wherein each gripper is associated with said blowing nozzle and said suction nozzle.

8. A gripper loom with a pneumatic gripper cleaning device, comprising:

at least one gripper, wherein said gripper is driveable by means of a gripper belt; and a cleaning apparatus, which further comprises:

a blowing device which has a blowing nozzle; and a suction device which has a suction nozzle, wherein said blowing nozzle of said blowing device is assigned to said at least one gripper, and further wherein said blowing nozzle is located externally of a weaving region, and further wherein said suction nozzle of said suction device is located opposite said blowing nozzle, wherein said blowing nozzle is directed towards an aperture of said suction nozzle, and further wherein air passes from said blowing nozzle to said suction nozzle during a blowing operation of said blowing nozzle.

9. The gripper loom of claim 8, wherein said blowing nozzle is arranged on a shed forming side of said gripper.

10. The gripper loom of claim 8, wherein an axis of said blowing-nozzle and an axis of said suction nozzle lie at least approximately on a common axis which extends parallel to a fabric web.

11. The gripper loom of claim 10, wherein said common axis forms an angle of 30° to 150° with a running direction of said gripper.

12. The gripper loom of claim 8, further comprising: a means for operating said suction device continuously.

13. The gripper loom of claim 8, wherein a magnet valve is arranged in a feed line to said blowing nozzle, and wherein its distance from said blowing nozzle is less than 200 mm.

14. The gripper loom of claim 13, wherein said magnet valve is adapted to be program-controlled.

15. The gripper loom of claim 11 further comprising a means for causing said blowing operation to take place during a filling insertion cycle which ranges from 290° to 70°.

16. The gripper loom of claim 8, further comprising: an air compressor means for use in conjunction with said blowing device wherein said blowing device supplies compressed air having pressure of less than 6 bar.

17. The gripper loom of claim 8, further comprising:

a supplying gripper on a first weaving side; and a fetching gripper on a second weaving side, wherein each gripper is associated with said blowing nozzle and said suction nozzle.

* * * * *